US005478684A

United States Patent [19]

Nakamura et al.

[11] Patent Number: 5,478,684

[45] Date of Patent: Dec. 26, 1995

[54] PHOTOCONDUCTOR FOR ELECTROPHOTOGRAPHY AND MANUFACTURING METHOD THEREOF

[75] Inventors: Yoichi Nakamura; Kimio Kurosawa, both of Nagano, Japan

[73] Assignee: Fuji Electric Co., Ltd., Kawasaki, Japan

[21] Appl. No.: 274,863

[22] Filed: Jul. 14, 1994

[30] Foreign Application Priority Data

Jul. 15, 1993 [JP] Japan ..... 5-174584

[51] Int. Cl.[6] ..... G03G 5/153

[52] U.S. Cl. ..... 430/58; 430/129

[58] Field of Search ..... 430/96, 127, 129, 430/58

[56] References Cited

U.S. PATENT DOCUMENTS 5,087,540 2/1992 Murakami et al. ..... 430/58

5,302,650 4/1994 Ito ..... 524/298

FOREIGN PATENT DOCUMENTS

3625766A1 2/1987 Germany .

2-43557 2/1990 Japan .

3-231753 10/1991 Japan .

*Primary Examiner*—John Goodrow

*Attorney, Agent, or Firm*—Kanesaka & Takeuchi

[57] ABSTRACT

A photoconductor for electrophotography is formed of photoconductive material, which includes a substrate, and laminated layers formed on the substrate. The laminated layers includes a charge generation layer and a charge transport layer. The charge generation layer is a film formed by applying to the substrate a coating liquid containing a charge generation material, a resin binder and a stabilizer, and heating and hardening the coated liquid at 120° C. or lower. The photoconductor has good electric characteristics, particularly a low residual potential.

8 Claims, 1 Drawing Sheet

PHOTOCONDUCTOR FOR ELECTROPHOTOGRAPHY AND MANUFACTURING METHOD THEREOF

BACKGROUND OF THE INVENTION AND RELATED ART STATEMENT

The present invention relates to a sensitive material or body for electrophotography and a manufacturing method thereof, and specifically to a material and a method of forming a charge-generation layer of a laminated photoconductive layer provided on a conductive substrate.

Conventionally, as materials for forming a photoconductor for electrophotography, inorganic photoconductive materials, such as selenium, selenium alloys, zinc oxides, cadmium sulfides and silicon, and organic photoconductive materials including compounds, such as anthracene, oxadiazole, triazole, imidazolone, imidazole, oxazole, imidazolydine, pyrazoline, benzothiazole, triphenylamine, benzoxazole, polylvinylcarbazole, vinyl polymer, polycyclic quinone, perylene, perynon, anthraquinone, phthalocyanine, dioxazine, indigo, thioindigo, squarylium, azolake, azo, thiapyrylium, quinacridone, cyanin, azulenium, triphenylmethane, hydrazone, triarylamine, triamine, N-phenylcarbazole, stilbene and polysilane, have been used.

A photoconductor has been made by forming a photoconductive layer, which is formed either by sublimation or vapor deposition of the above materials or by the application of a coating liquid containing a solvent into which such materials are dissolved and/or dispersed. A resin binder may sometimes be added to such a solvent as necessary before dissolution or dispersion.

The photoconductor must be able to retain surface charges in dark areas, to receive light to generate charges, and to transport generated charges. The photoconductor therefore includes a single-layer photoconductor constructed of a single material featuring all these functions, a function-separated photoconductor in which such functions are performed by separate materials formed into respective single layers, and a function-separated laminated photoconductor formed of a layer composed primarily of a material capable of generating charges and a layer composed primarily of a material capable of retaining surface charges and transporting charges.

Because of the flexibility, thermal stability, film formation capability, wide variety of materials and spectal sensitivities and low cost, the organic photoconductive materials have received many proposals for the application to the photoconductor, and many attempts have been made for practical use.

For example, anthracene compounds are disclosed in Japanese Patent Unexamined (KOKAI) Publication (herein after referred to JP KOKAI) No. 4-358157; oxadiazole compounds in Japanese Patent Examined (KOKOKU) Publication (herein after referred to JP KOKOKU) No. 34-5466 and U.S. Pat. No. 3,189,447; triazole compounds in JP KOKOKU No. 34-5467; imidazolone compounds in JP KOKOKU No. 34-8567; imidazole compounds in JP KOKOKU No. 34-10366; oxazole compounds in JP KOKOKU No. 35-11218 and JP KOKAI No. 56-123544; imidazolidine compounds in JP KOKOKU No. 35-11217; pyrazoline compounds in JP KOKOKU No. 37-16096, JP KOKOKU No. 52-4188 and JP KOKOKU 59-2023; benzothiazole compounds in JP KOKOKU 35-11219; triphenylamine compounds in U.S. Pat. No. 3,180,730; benzoxazole compounds in JP KOKOKU 35-11219; poly(vinylcarbazole) compounds in JP KOKOKU 34-10966; and vinyl polymer compounds in U.S. Pat. No. 3,162,532.

Phthalocyanine compounds are disclosed in JP KOKOKU 52-1662, JP KOKAI 58-100134, JP KOKAI 58-182639, JP KOKAI 59-44053, JP KOKAI 59-44054, JP KOKAI 59-155851, JP KOKAI 59-215655 and U.S. Pat. No. 3,816,118.

Azo compounds are disclosed in JP KOKOKU 60-45664, JP KOKAI 47-37543, JP KOKAI 56-94358, JP KOKAI 56-116039, JP KOKAI 57-58154, JP KOKAI 57-176055, JP KOKAI 58-122967, JP KOKAI 60-5941, JP KOKAI 60-153050 and JP KOKAI 63-305362.

Triphenylmethane compounds are disclosed in JP KOKOKU 45-555: hydrazone compounds in JP KOKOKU 55-42380, JP KOKAI 54-15028, JP KOKAI 57-101844, and JP KOKAI 1-102469; triarylamine compounds in JP KOKOKU 58-32372; triamine compounds in JP KOKAI 1-219838, JP KOKAI 4-13776, JP KOKAI 4-13777, European Patent No. 455,247 and Denshi Shashin Gakkaishi 29 (4), 366 (1990); N-phenylcarbazole compounds in JP KOKAI 57-148750; and stilbene compounds in JP KOKAI 58-198043.

To form an organic photoconductive material as a photoconductive layer on a conductive substrate, a coating liquid is prepared through the dissolution and/or dispersion of such a material in a solvent. In such a case, as a resin binder, a polycarbonate resin, a polyester resin, a polyamide resin, a polyurethane resin, an epoxy resin, a polyvinyl resin, a silicone resin, an acrylic resin and a copolymer of such resins or corresponding monomers are used individually or in combination as required.

In addition, an organic solvent is often used as a solvent. These organic solvents include aliphatic solvents, such as hexane and cyclohexane; halogenated solvents, such as dichloromethane, chloroform, carbon tetrachloride, 1,2-dichloroathane, 1,1,1-trichloroethane, tetrachloroethylene, trichloroethylene and 1,2,3-trichloropropane; alcohols, such as methanol, ethanol, isopropanol and ethylene glycol; ketones, such as acetone, methyl ethyl ketone, cyclohexanone and isophorone; aromatic solvents, such as benzene, toluene and xylene; ethers, such as dimethyl ether, diethyl ether and tetrahydrofuran; and nitro solvents, such as nitromethane and nitroethane, which are used individually or in combination as required.

When a photoconductor is manufactured, an organic photoconductive material, and if necessary together with a resin binder, is dissolved and/or dispersed in the above organic solvent to prepare a coating liquid, which is then applied to a conductive substrate by a dipping coating method or other method. The solvent is then volatilized by means of reducing pressure, leaving as it is, or ventilating or heating to form a photoconductive layer.

As described above, there is a wide variety of organic materials available for use in many combinations, all of which allow a film to be easily formed by coating and are suitable for the function-separated laminated photoconductor. However, there is no organic material for sufficiently satisfying all the characteristics required for the photoconductor, and the organic material causes an undesirable high residual potential in the photoconductor.

In view of the above problems, an object of the invention is to provide a photoconductor with good electric characteristics, particularly a low residual potential.

Another object of the invention is to provide a method of sensitive body with good electric characteristics easily.

SUMMARY OF THE INVENTION

The above objects are achieved in the present invention, wherein a photoconductive layer composed of laminated layers including a charge generation layer and a charge transport layer is formed on a conductive substrate. The charge generation layer is formed by applying on the substrate a coating liquid containing a charge generation material, a resin binder and a stabilizer, and subsequently heating and hardening the same. The substrate can be heated and hardened at 120° C. or lower.

A vinyl chloride resin can be used as the resin binder, and a di-n-octyl tin maleate polymer can be used as the stabilizer with the vinyl chloride resin.

It is known that resins generally degrade under the effects of heat, light and oxygen (for example, see "Zouho purasutikku oyobi Gomu-you Tenkazai Binran"; Kagaku Kougyo Sha (1989)).

This invention has been made because the inventors have discovered, in addition to the fact that resins degrade easily, that if a resin is used for a photoconductor as a binder together with a charge generation material, degradation of the resin acting as a binder or the charge generation material itself is promoted by the charge carrier (electrons and/or holes) discharged from the material as a result of light and heat, or by the charge generation material acting as a reaction field.

In this invention, therefore, a stabilizer is added to the coating liquid for forming the charge generation layer. The charge generation layer is formed by applying the coating liquid with such a stabilizer, and subsequently heating and hardening the same. Accordingly, degradation of the resin binder and the charge generation material is reduced due to general factors such as heat, light and oxygen and due to the above factors by using together with charge generation material, or due to capturing of degradation products, such as radicals, resulting from heat, light or oxygen. As a result, the lowering of the electric characteristics of the photoconductor is reduced. The substrate can be heated and hardened at 120° C. or lower.

DETAILED DESCRIPTION OF PREFERRED EMBODIMENTS

Figure 1:
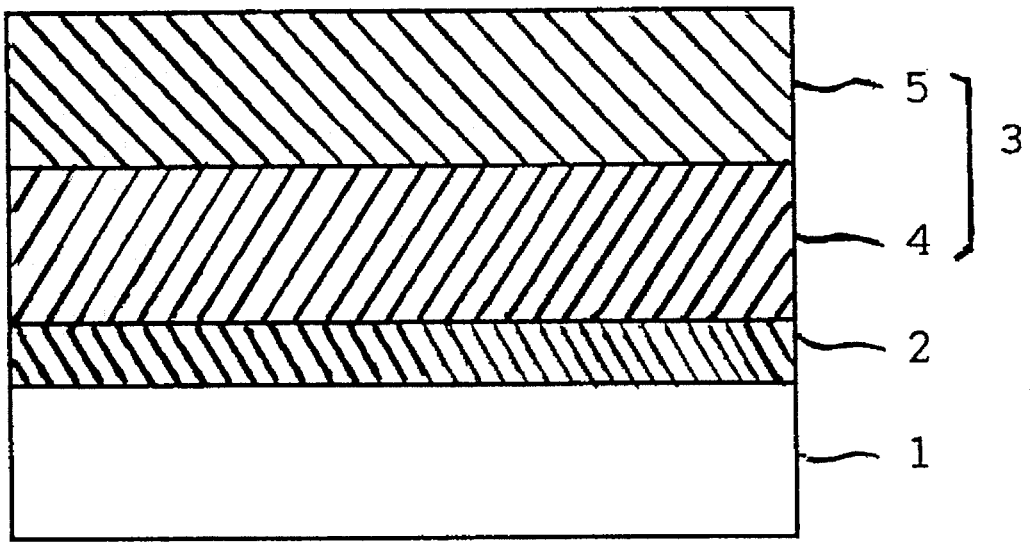
FIG. 1 is a cross-sectional view of an embodiment of a photoconductor in accordance with the invention.

An embodiment of the invention is described below. However, the invention is not limited to this embodiment in terms of the structure and material of the photoconductor.

FIG. 1 is a cross-sectional view illustrating an embodiment of a photoconductor in accordance with the invention, wherein a photoconductive layer 3 formed of a charge generation layer 4 and a charge transport layer 5 is laminated on a conductive substrate 1 through an undercoating layer 2.

The conductive substrate 1 formed of a metal, such as aluminum, stainless steel or nickel; glass; or a resin, constitutes an electrode for the photoconductor and supports the other layers. It may take a shape of a cylinder, plate or film, depending on the device with which the photoconductor is used.

The undercoating layer 2 is provided as required, and is formed by electrolytic oxidation of an inorganic material, such as an aluminium oxide, or by the application of a coating liquid containing a solvent into which a resin have been dissolved, or by the application of melted resin. A suitable material can be selected for the layer 2 depending on its purpose, and it may be used for adjustment of the shape, adhesion improvement, electric resistance and control of the charge injection capability of the conductive substrate, or prevention of interference with light reflected from the substrate. In addition, such a material should not prevent the retention, generation, or transportation of electric charges.

Regarding the resin, a polyamide resin, a polyurethane resin, an epoxy resin, a polyvinyl resin and a copolymer of these resins or corresponding monomers are used individually or in combination, as required. A suitable resin can be selected depending on the composition of the conductive substrate or the photoconductive layer. The film thickness of the undercoating layer 2 should generally be 50 micro meter or less to facilitate adequate electrical resistance and charge injection capability, and should preferably be 10 micro meter or less.

The charge generation layer 4, which is a component of the photoconductive layer 3, is formed by the application of a coating liquid containing a solvent into which a charge generation material and a stabilizer have been dissolved and/or dispersed along with a resin binder. This charge generation layer must have the ability to receive light and generate charges. The layer 4 should have a high charge-generation efficiency and the ability to inject generated charges into the charge transport layer 5. The charge generation layer 4 should have a low electric field dependency and should maintain its charge generation efficiency and the charge injection capability even in a low electric field.

Charge generation materials include compounds, such as polycyclic quinone, perylene, perynon, anthraquinone, phthalocyanine, dioxazine, indigo, thioindigo, squarylium, azolake, azo, thiapyrylium, quinacridone, cyanine, azulenium and triphenylmethane. Among these materials, a suitable material can be selected depending on the wavelength of the exposure light used to form images. Regarding the resin binder, a polycarbonate resin, a polyester resin, a polyamide resin, a polyurethane resin, an epoxy resin, a polyvinyl resin, a polyvinyl chloride resin, a silicone resin, an acrylic resin and a copolymer of these resins or corresponding monomers are used individually or in combination, as required.

The stabilizers used in this embodiment include inorganic salts, such as tribasic lead sulfate, dibasic lead phosphite, basic lead sulfate, lead silicate, and basic lead corbonate; lead silicate and basic lead carbonate; lead metallic soap, such as dibasic lead stearate, lead stearate, dibasic lead phthalate, lead salicylate and tribasic lead maleate; cadmium metallic soap, such as cadmium stearates, cadmium lauric acids, cadmium octylate, cadmium ricinoleate, cadmium benzoate and cadmium naphthenate; barium metallic soap, such as barium stearate, barium laurate and barium ricinoleate; calcium metallic soap, such as calcium ricinoleate; tin metallic soap, such as tin stearate, tin octylate and tin laurate; other metallic soap, such as aluminium stearate, magnesium stearate, strontium stearate and tin stearate; organic tin laurates, such as dibutyl tin laurates and dioctyl tin laurates; organic tin mateates, such as dibutyl tin maleate and dioctyl tin maleate; sulfurous organic tin; organic tin, such as dimethyl tin, trimethyl tin, monobutyl tin, and tetrabutyl tin; phenols, such as 2,6-di-tert-butyl-4-methylphenol, 2,2'-methylenebis (4-methyl-6-tert-butylphenol), 4,4'-butylidene bis (3-methyl-6-tert-methylphenol), 4-4'-butylidene bis (3-methyl-6-tert-methylphenol), 4-4'-thiobis (3-methyl-6-tert-butylphenol),2,2'-thiobis (4-methyl-6-tert-butylphenol), 1,3,5-trimethyl-2,4,6-tris (3,5-di-tert-butyl-4-hydroxybenzyl) benzene, and 1,3,5-tris (2-methyl-4-hydroxy-5-tert-butylphenol) butane; sulfides, such as dilaurylthiodipropionate and distearylthiodipropionate; phosphite, such as tridecyl phosphite, diphenyldecyl phosphite, triphenyl phosphite, and trisnonylphenyl phosphite; benzophenones, such as 2-hydroxy-4-methoxybenzophenone,2,2'-dihydroxy- 4-methoxybenzophenone, 2-hydroxy-4-octoxybenzophenone, 2,4-dihydroxybenzophenone, and resorcinolmonobenzoate; benzotriazoles, such as 2(2'-hydroxy-5-methylphenyl) benzotriazole; acrylates, such as 2-ethylhexyl-2-cyano-3,3'-diphenyl acrylate and ethyl-2-cyano-3,3'-diphenyl acrylate; salicylates, such as phenyl salicylate, 4-tert-butylphenyl salicylate, and p-octylphenyl salicylate; and nickel-bisoctylphenylsulfide and nickel [2,2'-thiobis (4-tert-octylphenyl)-n-butylamine]. These materials can be used individually or in combination, as required.

The amount of the resin binder relative to the charge generation material is 5–2,000 wt %, preferably 25–150 wt %. In case the amount of the resin binder is less than 5 wt %, the charge generation layer may cause defective film formation, and in case the amount of the resin binder is more than 2,000 wt %, the electric characteristics, such as residual voltage, become worse. The amount of the resin binder relative to the charge generation material is selected and determined based on the kind of the resin binder and the charge generation material, and the electric characteristics of the photoconductor.

Also, the amount of the stabilizer relative to the resin binder is 0.01–60 wt %, preferably 0.5–20 wt %. In case the amount of the stabilizer is less than 0.01 wt %, the effect of the stabilizer is insufficient. In case the amount of the stabilizer is more than 60 wt %, the charge generation layer may cause defective film formation, and the electric characteristics, such as retentivity and residual voltage of the photoconductor, become worse. The amount of the stabilizer relative to the resin binder is selected and determined based on the kind of the resin binder and the stabilizer, temperature at the time of formation of the photoconductor and the electric characteristics of the photoconductor.

The film thickness of the charge generation layer should generally be 5 micro meter or less to facilitate adequate charge generation and charging capabilities, and should preferably be 1 micro meter or less.

The charge transport layer 5, which is a component of the photoconductive layer 3, is formed by the application of a coating liquid prepared either by melting a charge transport material, by dissolving and dispersing a charge transport material into a solvent, or by dissolving and dispersing a charge transport material together with a resin binder into a solvent. The charge transport layer 5 has the ability to receive and transport charges. The layer 5 should have a high charge transport efficiency and the ability to inject charges that have been generated in the charge generation layer 4. This charge transport layer 5 should preferably have a low electric field dependency and maintain its charge transport efficiency and charge injection capability even in a low electric field.

Charge transport materials include compounds, such as anthracene, oxadiazole, triazole, imidazolone, imidazole, oxazole, imidazolydine, pyrazoline, benzothiazole, triphenylamine, benzoxazole, poly(vinylcarbazole), vinylupolymer, hydrazone, triarylamine, N-phenylcarbazole, stilbene and polysilane. A suitable material can be selected from these compounds, depending on the development method and the charge transport layer's capability of injecting charges from the charge generation layer.

Regarding the resin binder, a polycarbonate resin, a polyester resin, a polyamide resin, a polyurethane resin, an epoxy resin, a silicone resin, an acrylic resin and a copolymer of these resins or corresponding monomers are used individually or in combination, as required. The film thickness of the charge transport layer should generally be 60 micrometer or less to facilitate adequate charge generation capability and printing resistance, and should preferably be 30 micrometer or less.

EXAMPLE 1

A blender was used to blend 10 wt. pts. of X-type non-metallic phthalocyanine, 10 wt. pts. of vinyl chloride resin (manufactured by Nippon Zeon Co., Ltd.; MR 110), 1 wt. pts. of di-n-octyl tin maleate polymer (manufactured by Wako Pure Chemical Industries Ltd.), 686 wt. pts. of dichloromethane, and 294 wt. pts. of 1,2-dichloroethane for one hour to dissolve and disperse the ingredients. Further, an ultrasonic disperser was used to dissolve and disperse the mixture for 30 minutes to prepare a coating liquid for a charge generation layer. This coating liquid was applied to an aluminium deposition polyester film substrate by a wire-bar method, and the substrate was then dried at 120° C. to form a charge generation layer with a film thickness of approximately 0.5 micro meter.

A coating liquid for a charge transport layer formed of 70 wt. pts. of poly (2,6-dimethoxyanthracene-9,10-diolyl dodecanedioate) resin, 7 wt. pts. of silane coupling agent (manufactured by Shin-Etsu Chemical Industries Ltd.; KP-340), and 923 wt. pts. of tetrachloroethylene was then applied to the charge generation layer by the wire-bar method. The substrate was then dried at 60° C. to form a charge transport layer with a film thickness of 20 micro meter. In this way, a photoconductor was obtained.

EXAMPLE 2

A photoconductor was formed in the same manner as described in Example 1, except that X-type non-metallic phthalocyanine used in the coating liquid for the charge generation layer was replaced with titanylphthalocyanine.

EXAMPLE 3

A coating liquid was prepared in the same manner as described in Example 1, except that the coating liquid used in the charge transport layer was replaced with one formed of 100 wt. pts. of 4-[bis(phenylmethyl) amino] benzaldehyde diphenyl hydrazone, 100 wt. pts. of polycarbonate resin (Mitsubishi Gas Chemical Co., Inc.; Iupilon (registered trade name) PCZ-200), 800 wt. pts. of dichloromethane and 1 wt. pts. of silane coupling agent (Shin-Etsu Chemical Industries Ltd.; KP-340).

EXAMPLE 4

A photoconductor was constructed in the same manner as described in Example 3, except that X-type non-metallic phthalocyanine used for the coating liquid for the charge generation layer was replaced with titanylphthalocyanine.

Comparative Example 1

A sensitive body was constructed in the same manner as described in Example 1, except that 1 wt. pts. of di-n-octyl tin maleate polymer was not added to the coating liquid for the charge generation layer.

Comparative Example 2

A photoconductor was constructed in the same manner as described in Example 2, except that 1 wt. pts. of di-n-octyl tin maleate polymer was not added to the coating liquid for the charge generation layer.

Comparative Example 3

A photoconductor was constructed in the same manner as described in Embodiment 3, except that 1 wt. pts. of di-n-octyl tin maleate polymer was not added to the coating liquid for the charge generation layer.

Comparative Example 4

A photoconductor was constructed in the same manner as described in Embodiment 4, except that 1 wt. pts. of di-n-octyl tin maleate polymer was not added to the coating liquid for the charge generation layer.

Comparative Example 5

A photoconductor was constructed in the same manner as described in Example 1, except that when the charge generation layer was formed, the substrate was dried at 130° C.

Comparative Example 6

A photoconductor was constructed in the same manner as described in Example 2, except that when the charge generation layer was formed, the substrate was dried at 130° C.

Comparative Example 7

A photoconductor was constructed in the same manner as described in Example 3, except that when the charge generation layer was formed, the substrate was dried at 130° C.

Comparative Example 8

A photoconductor was constructed in the same manner as described in Example 4, except that when the charge generation layer was formed, the substrate was dried at 130° C.

The electrophotographic characteristics of the photoconductor obtained in this manner were evaluated at room temperature using the electrostatic recording paper testing device "SP-428", which is manufactured by Kawaguchi Electric Works Inc.

The photoconductor was charged in a dark area for 10 seconds by −5 kV corona discharge, and the charged potential Vo (V) was measured. The corona discharge was then stopped and the photoconductor was left in the dark area for two seconds. A 1 micro W/cm$^2$ laser beam with a wavelength of 780 nm was irradiated on the surface of the photoconductor, and the residual potential was then measured. The results are shown in Table 1.

TABLE 1

| Photoconductors No. | Residual potential (V) |
|---|---|
| Example 1 | −19 |
| Example 2 | −16 |
| Example 3 | −13 |
| Example 4 | −10 |
| Comparative example 1 | −102 |

TABLE 1-continued

| Photoconductors No. | Residual potential (V) |
|---|---|
| Comparative example 2 | −97 |
| Comparative example 3 | −91 |
| Comparative example 4 | −82 |
| Comparative example 5 | −125 |
| Comparative example 6 | −117 |
| Comparative example 7 | −93 |
| Comparative example 8 | −88 |

Table 1 shows that all the photoconductor in the Examples are well-constructed because they have a small absolute value of residual potential, while the photoconductors in the Comparative Examples have problems because they have a large absolute value of residual potential. A suitable charge generation layer could be formed at a heating temperature of 120° C., but not at a heating temperature of 130° C. Further, it was revealed that the temperature for conducting heating and hardening may be 120° C. or lower.

In accordance with the invention, a photoconductor for electrophotography including a photoconductive layer composed of laminated layers, which include a charge generation layer and a charge transport layer on a conductive substrate, is constructed such that the charge generation layer is formed by the application of a coating liquid containing a charge generation material, a resin binder and a stabilizer, which has subsequently heating and hardening processes. The charge generation layer is provided in this manner, so that a photoconductor with good electric characteristics, particularly a low residual potential, is obtained. The substrate can be heated and hardened at 120° C. or lower.

What is claims is:

1. A photoconductor for electrophotography, comprising, a substrate, and a photoconductive material formed of laminated layers disposed on the substrate, said laminated layers including a charge generation layer and a charge transport layer disposed on the charge generation layer, said charge generation layer being in a form of a film prepared by a coating liquid consisting essentially of a charge generation material, a resin binder for the charge generation material and a stabilizer for reducing degradation of the resin binder and the charge generation material, an amount of the resin binder relative to the charge generation material being 5–2,000 wt % and an amount of the stabilizer relative to the resin binder being 0.01–60 wt %, said charge generation layer being heated and hardened at 120° C. or lower so that lowering of electric characteristics of the photoconductor by heat, light and oxygen is reduced.

2. A photoconductor for electrophotography of claim 1, wherein the resin binder included in the charge generation layer is a vinyl chloride resin.

3. A photoconductor for electrophotography of claim 1, wherein the resin binder included in the charge generation layer is a vinyl chloride resin, and the stabilizer is a di-n-octyl tin maleate polymer.

4. A photoconductor for electrophotography of claim 1, wherein said laminated layers further include an undercoating layer situated directly on the substrate.

5. A method of manufacturing a photoconductor for electrophotography, comprising, preparing a coating liquid for a charge generation layer containing a charge generation material, a resin binder for the charge generation material and a stabilizer for reducing degradation of the resin binder and the charge generation material, an amount of the resin binder relative to the charge generation material being 5–2,000 wt % and an amount of the stabilizer relative to the resin binder being 0.01–60 wt %, applying the coating liquid on a conductive substrate, heating and hardening the coating liquid at 120° C. or lower to form the charge generation layer, and forming a charge transport layer on the charge generation layer to prepare a photoconductive material formed of the charge generation layer and the charge transport layer so that lowering of electric characteristics of the photoconductor by heat, light and oxygen is reduced.

6. A method of manufacturing a photoconductor of claim 5, wherein the resin binder contained in the charge generation layer is a vinyl chloride resin.

7. A method of manufacturing a photoconductor of claim 5, wherein the resin binder contained in the charge generation layer is a vinyl chloride resin, and the stabilizer is a di-n-octyl tin maleate polymer.

8. A method of manufacturing a photoconductor of claim 5, further comprising forming an undercoating layer directly on the substrate, said charge generation layer being formed on the undercoating layer.

* * * * *